US005294007A

United States Patent [19]

Edmondson

[11] Patent Number: 5,294,007

[45] Date of Patent: Mar. 15, 1994

[54] BOOT HANGER SYSTEMS

[76] Inventor: Michael T. Edmondson, 4314 S. Crockett, Amarillo, Tex. 79110

[21] Appl. No.: 21,981

[22] Filed: Feb. 24, 1993

[51] Int. Cl.[5] ..... A47F 7/00

[52] U.S. Cl. ..... 211/34; 211/118; 248/215

[58] Field of Search ..... 211/35, 34, 113, 118, 211/117; 248/215

[56] References Cited

U.S. PATENT DOCUMENTS

| | | | |
|---|---|---|---|
| 283,418 | 8/1883 | Ries . | |
| 908,392 | 12/1908 | Casteel | 211/34 |
| 1,568,998 | 1/1926 | Bruce | 211/35 |
| 1,611,397 | 12/1926 | Wells | 211/118 X |
| 2,322,188 | 6/1943 | Bonniwell . | |
| 2,679,937 | 6/1954 | Fulster . | |
| 2,972,419 | 2/1961 | Zelen et al. | 211/113 X |
| 3,249,231 | 5/1966 | Matlock . | |
| 4,034,865 | 7/1977 | Batts et al. | 211/118 |
| 4,690,288 | 9/1987 | Mitchell | 211/113 |
| 4,779,743 | 10/1988 | McKinnon . | |
| 4,986,427 | 1/1991 | Law et al. | 211/117 X |

*Primary Examiner*—Robert W. Gibson, Jr.
*Attorney, Agent, or Firm*—Cornelius J. Husar

[57] ABSTRACT

The disclosure relates to a boot hanging system for conveniently storing western style boots when not in use. There are two disclosed embodiments, one of which attaches to the top of a conventional household door and the other is a wall mounted version. Both embodiments include a main hanger member to which leather straps of different lengths and hooks are releaseably attached to provide a staggered effect to the boots hanging thereon. Each embodiment can accommodate up to five pairs of boots and provide ready access to the boots while simultaneously taking up a minimum amount of household storage space.

12 Claims, 3 Drawing Sheets

BOOT HANGER SYSTEMS

BACKGROUND OF THE INVENTION

The subject invention relates to a system for conveniently storing western style boots when not in use. More specifically, it relates to two embodiments wherein a plurality of pairs of boots may be stored in a neat manner while taking up a minimum amount of household space.

It is common knowledge that boot enthusiasts usually provide themselves with a plurality of pairs of different boots. There are many styles, colors and materials that work boots and dress boots are available in and frequently found in one's wardrobe. Thus one who avails himself of these different types of boots quickly finds that the storage of these boots in a convenient, readly accessible place is a common problem. Storage of these boots on the floor of a closet usually results in the entire floor becoming cluttered with boots to the point where one can hardly enter the closet, much less find an article of clothing or a particular pair of boots.

Additionally, a closet is usually not well lighted and as a result, a further problem of selecting the matching boots of a desired pair presents itself. There are presently available single pair boot hangers of various types. However, there are no known boot hangers wherein a plurality of pairs may be conveniently stored in an out-of-the-way place with all boots arranged in an orderly paired fashion providing easy access to the boots.

SUMMARY OF THE INVENTION

In view of the above deficiencies of the prior art, applicant has developed two boot hanging systems. Each of which can accommodate up to five pairs of boots. One embodiment relates to a door mounted system while the other embodiment relates to a wall mounted system. Both systems can be readily installed without the use of special tools and readily re-located, if so desired. Each system utilizes, in addition to the main hanger member, a plurality of unique straps and hooks which present a pleasing appearance of staggered pairs of boots. The straps are made of quality leather and are provided with brass rivets to form the end loops thus further favorably adding to its appearance.

OBJECTS OF THE INVENTION

An object of the invention is to provide a boot hanging system wherein a plurality of boots may be hung therefrom.

Another object of the invention is to provide a boot hanging system which allows convenient boot storage with a minimum amount of space.

A further object of the invention is to provide two hanger systems which can readily be mounted or demounted without requiring special skills or tools.

Yet another object of the invention is to provide a boot hanging system wherein mating boots are arranged in side-by-side relation.

A still further object of the invention is to provide a boot hanging system which presents a neat appearance in use.

These and other objects of the instant invention will become more apparent hereinafter. The instant invention will now be described with particular reference to the accompanying drawings which form a part of this specification wherein like reference characters designate the corresponding parts in the several views.

DETAILED DESCRIPTION OF THE DRAWINGS

Figure 1:
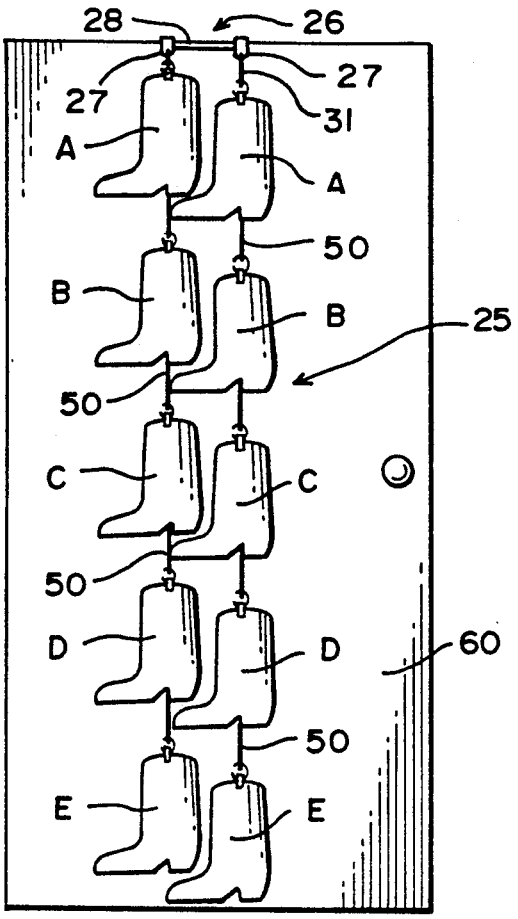
FIG. 1 is an elevational view illustrating a first embodiment of the invention.

Referring now to FIG. 1, there is shown an elevational view of the first embodiment of applicant's novel boot hanging system designated generally by reference numeral 25 mounted on door 60. As illustrated, five pairs of boots designated A—A, B—B, C—C, D—D and E—E are suspended from main hanger member 26. Main hanger member 26 comprises a pair of spaced, inverted U-spaced members 27 which snugly fit over the top of door 60. Interconnecting U-shaped members 27 is a horizontal support member 28 which serves to keep U-shaped members 27 parallel to each other so that when boots A—A are suspended therefrom, they will hang in a straight line.

Figure 2:
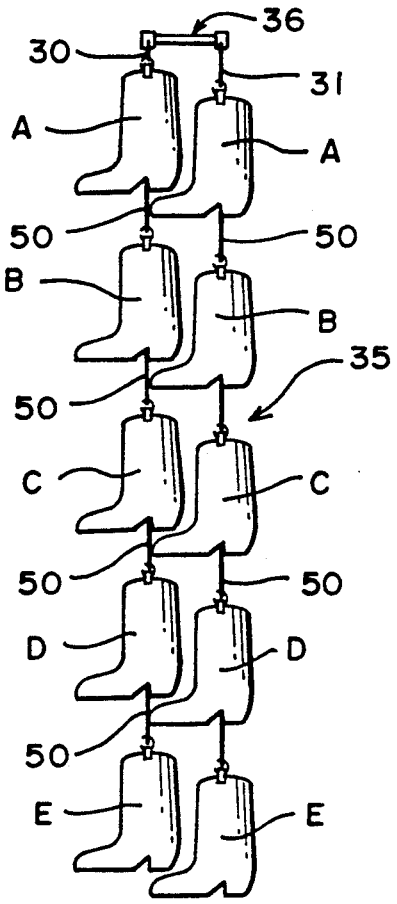
FIG. 2 is an elevational view illustrating a second embodiment of the invention.

FIG. 2 is an elevational view of another embodiment of applicant's novel boot hanging system designated by reference numeral 35 illustrating the arrangement of five pairs of boots A—A through E—E. This second embodiment relates to the hanging of the boots on any flat surface such as a wall with screws or fasteners holding main hanger member 36 thereto.

Figure 3:
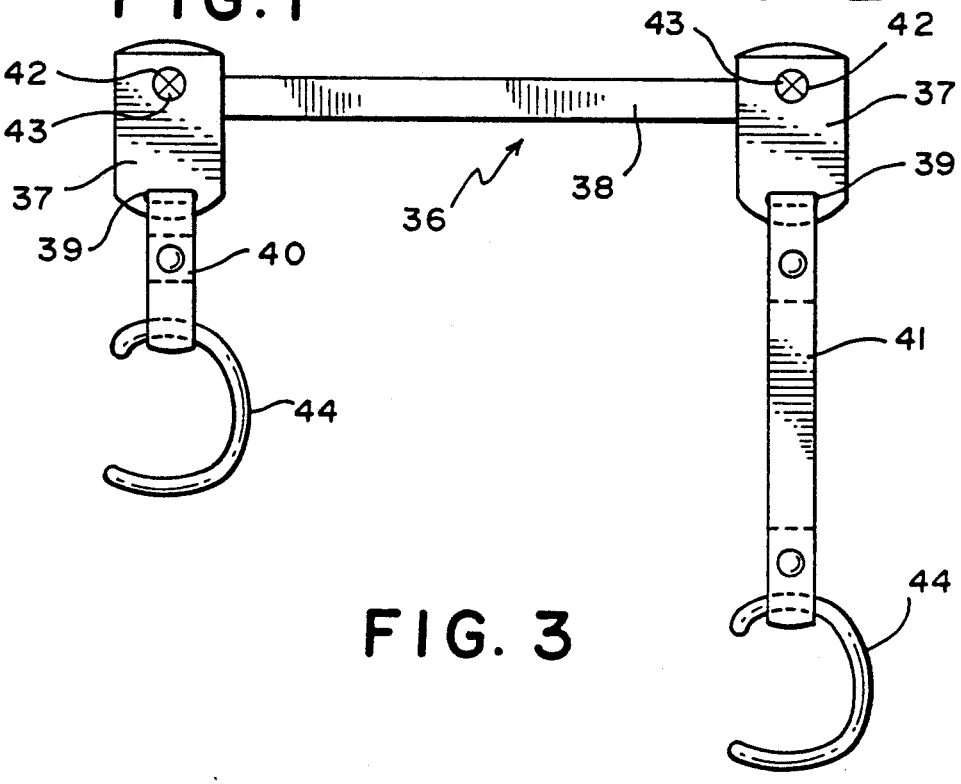
FIG. 3 is a close-up view of the main hanger member and first tier set-up as used in FIG. 2.

FIG. 3 is an enlarged close-up view of the second embodiment 35, its main hanger 36 and its associated components. As indicated, main hanger 36 includes a pair of spaced strap support members 37 which are interconnected by a horizontal member support 38. As in the first embodiment, horizontal support member 38 serves to keep strap support members 37 parallel to each other so that when the boots A—A are suspended therefrom, they too, will remain in a straight vertical line. Although strap support members 37 and horizontal support member 38 are shown as separate members, it is possible to have these elements made as a unitary molded plastic member or other suitable material.

Each strap support member 37 is provided with an elongated slot 39 through which the free end of first tier straps 40 and 41 enter. A more detailed explanation of the manner of attaching first tier straps 40 and 41 will be presented in the discussion of FIGS. 5 and 6. The upper portion of each strap support member 37 is provided with a centrally located hole 42 for receiving a screw 43 or other fastener for securing main hanger member 36 to a flat wall surface or any other desired location. It is to be noted that the rear surfaces of strap support members 37 and horizontal support member 38 present a continuous flat surface without any interruptions permitting flush contact with the desired mounting location. Each of first tier straps 40 and 41 receive a reverse C-shaped hook 44 which engages the pull-tabs A'—A' on the first tier boots A—A. The lower left portion of FIG. 3 is shown with a second reverse C-shaped hook 34 prior to installation on strap 40. The purpose of this illustration is to clearly show the recess 45 which is located in the upper inner surface of hook 34. The width and depth of recess 45 is slightly larger than the width and thickness of first tier strap 40 which is received therein as shown by the broken lines. The purpose of recess 45 is to prevent reverse C-shaped hook 34 from sliding out of the loop in the first tier strap 40 when a boot is removed from reverse C-shaped hook 34. Although recess 45 is shown only in this view, it is in fact, included in all reverse C-shaped hooks 34.

Figure 4:
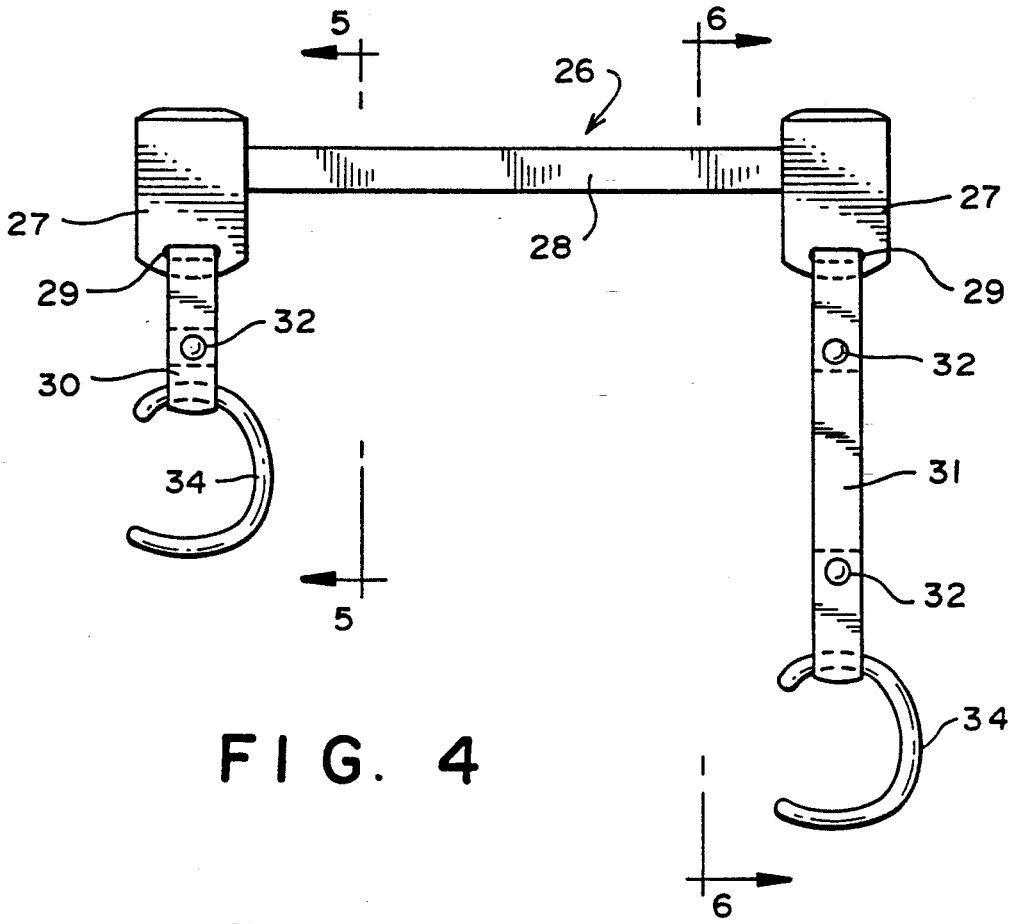
FIG. 4 is a close-up view of the main hanger member and first tier set-up as used in FIG. 1.

Referring now to FIG. 4, there is shown an elevational close-up view of main hanger 26 as used in the first embodiment 25 of FIG. 1. As illustrated, first tier straps 30 and 31 have been inserted through elongated slots 29 in each of inverted U-shaped members 27. Horizontal support member 28 interconnects with inverted U-shaped members 27 and maintains them in parallel relation to insure proper hanging of boots A—A through E—E. As further shown, first tier straps 30 and 31 are of different length. First tier strap 30 is approximately one and one-half inches in effective length. Before securement with brass rivet 32 it was somewhat longer to permit both ends to double back and form loops prior to securement with brass rivets 32. First tier strap 31 is approximately four inches in effective length. Again, the overall length is somewhat longer to allow for doubling back to form a loop at each end. Both straps 30 and 31 are approximately one-half inch in width and made of quality leather. When brass rivets 32 have been inserted through straps 30 and 31 there is a sharp, pleasant, contrasting appearance of the brass rivets 32 with the background of tanned leather straps 30 and 31.

The purpose of using different length straps 30 and 31 is to allow an interlacing or staggering effect between the two vertical rows of boots. It is to be noted that only the first tier of straps are of different length. All subsequent straps 50 are of the same length which is approximately sixteen and one-half inches. With this system of straps 50 and hooks 34 added to the first tier of straps 30 and 31, five pairs of boots can be conveniently stored behind a household door or on a wall mount 36 of the second embodiment 35.

Figure 5:
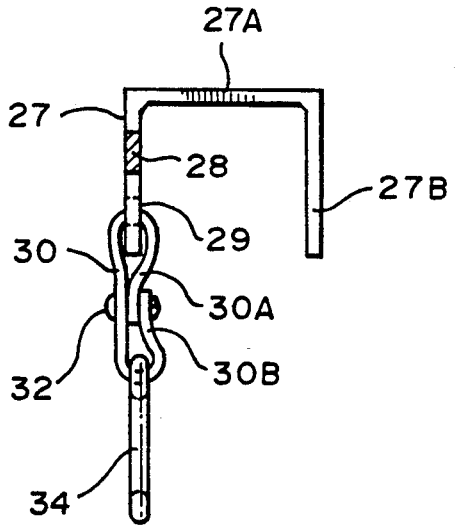
FIG. 5 is a sectional view taken on the plane 5—5 of FIG. 4 illustrating the first tier strap and hook arrangement.

Referring now to FIG. 5, there is shown a sectional view taken on the plane 5—5 of FIG. 4. As shown, inverted U-shaped members 27 include a top portion 27A and a rear portion 27B which fit over the top of and rear portion of a door. First tier strap 30 is shown with its uppermost end 30A doubled back to form a loop after insertion through slot 29. Lowermost end 30B has been doubled back to form a loop for receiving reverse C-shaped hook 34. Both ends 30A and 30B have been securely fastened with a single brass rivet 32.

Figure 6:
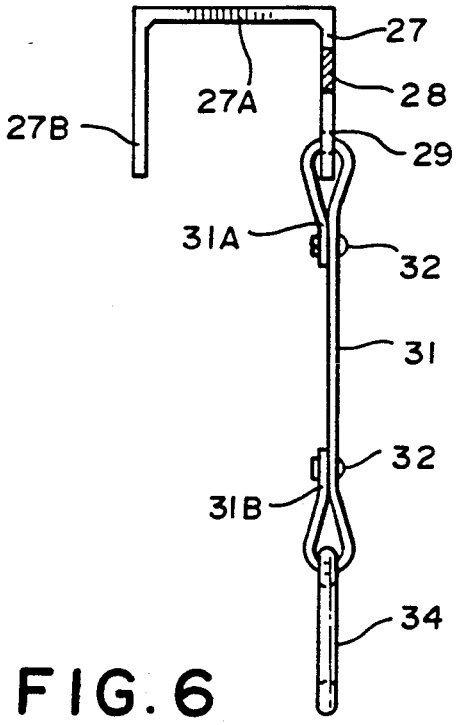
FIG. 6 is a sectional view taken on the plane 6—6 of FIG. 4 illustrating the other first tier strap and hook arrangement.

FIG. 6 is a sectional view of FIG. 4 taken along plane 6—6 looking at the mounting of first tier strap 31. As illustrated, uppermost end 31A of strap 31 has been inserted through slot 29 and then doubled back to form a loop which is secured by brass rivet 32. Lowermost end 31B of strap 31 is likewise formed into a loop for receiving hook 34. End 31B is secured closed by means of a second brass rivet 32.

Figure 7:
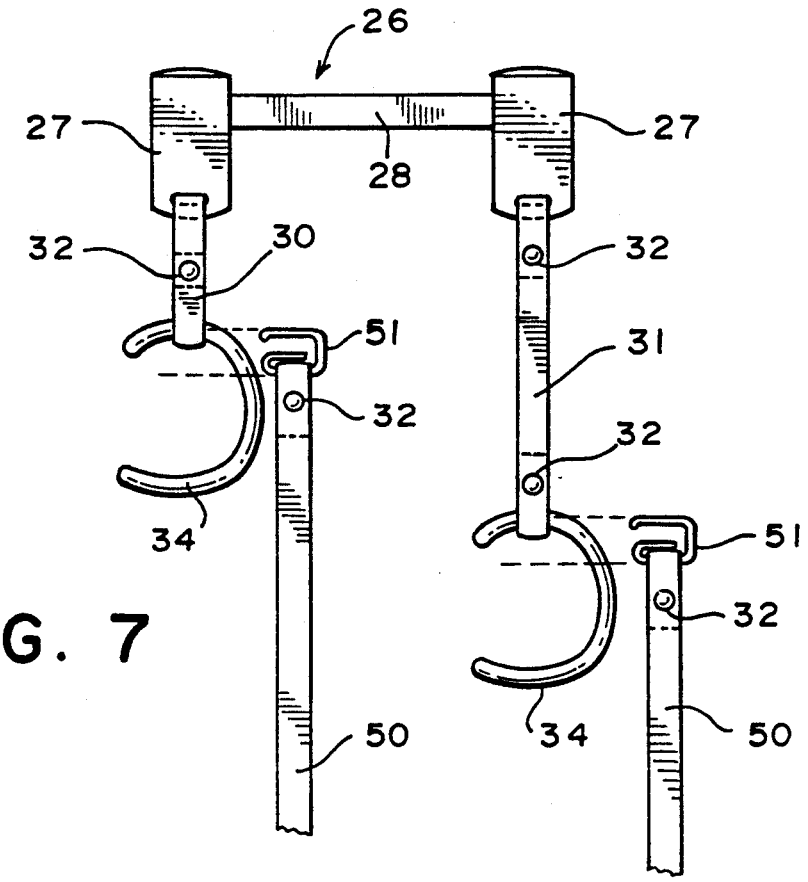
FIG. 7 is an elevational view showing the first tier straps and hooks attached to the main hanger member with subsequent tier straps about to be attached.

FIG. 7 is an elevational view of the first embodiment main hanger member 26 with first tier straps 30 and 31 attached thereto and reverse C-shaped hooks 34 attached to the lower ends thereof. Subsequent tier straps 50 are shown with hooks 51 attached tot he upper ends in preparation for attachment to first tier straps 30 and 31. Hooks 51 are inserted through loops at the ends of straps 30 and 31 behind reverse C-shaped hooks 34. The lowermost ends of subsequent tier straps 50 is not shown, however for completeness, it is to be understood that a loop is formed at the lower most end of each strap 50 and a reverse C-shaped hook is inserted therethrough as shown at 34 relative to first tier straps 30 and 31.

Figure 8:
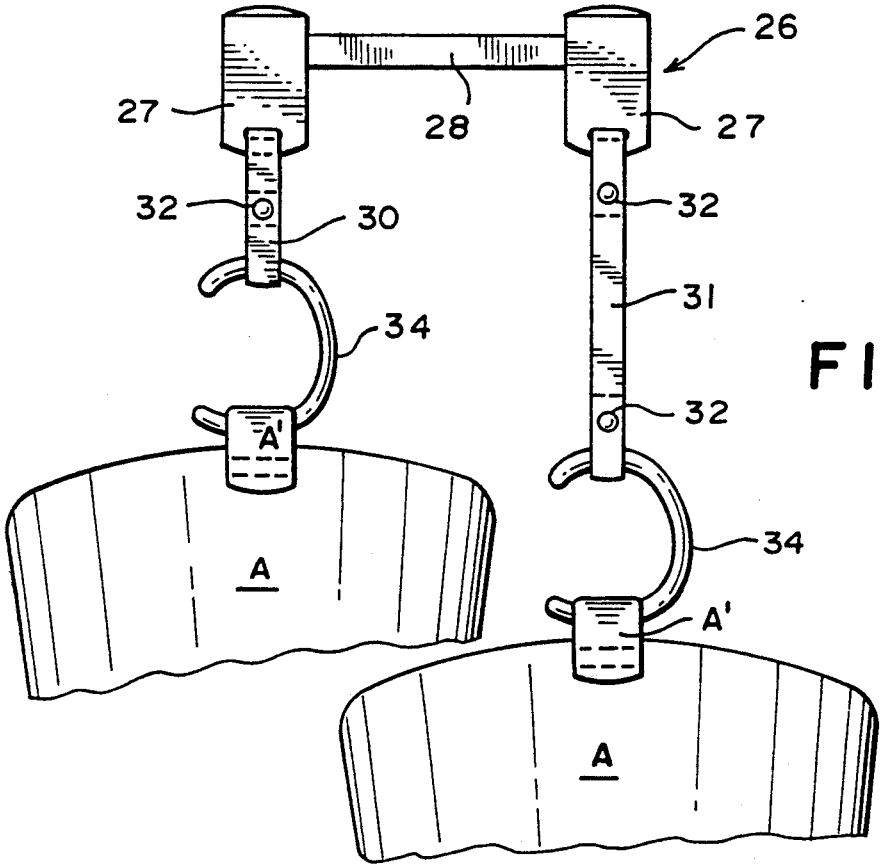
FIG. 8 is an elevational view showing the door mounted embodiment with the first tier of boots attached thereto.

FIG. 8 is a close-up view of the first embodiment main hanger member 26 with the first tier straps 30 and 31 secured to inverted U-shaped members 27. First tier boots A—A are shown hanging from reverse C-shaped hooks 34 which have been inserted through pull tabs A'—A'. Although each embodiment of the instant invention is capable of holding up to five pairs of boots, the advantages of the invention can be realized with any number less than five.

While the invention has been described in its preferred embodiments, it is to be understood that the words which have been used are words of description rather than words of limitation and that changes may be made within the purview of the appended claims without departing from the full scope or spirit of the invention.

Having thus described my invention, I claim:

1. A boot hanger system for hanging a plurality of pairs of western style boots which include pull tabs at the upper portion thereof, said boot hanger system comprising:

main hanger means including a first pair of spaced boot supporting members;

support means interconnected with said first pair of spaced boot supporting members;

first offset tier boot supporting means vertically offset relative to each other and connected to said first pair of spaced boot supporting members; and a plurality of subsequent offset tier boot supporting means operably connected to said first offset tier boot supporting means with subsequent offset tier boot supporting means after said first subsequent offset tier boot supporting means operably connected to the immediately preceeding subsequent offset tier boot supporting means whereby a plurality of pairs of western style boots can be stored in neat overlappinhg vertical rows while occupying a minimum amount of storage space.

2. A boot hanger system as defined in claim 1 wherein each of said first pair of spaced boot supporting members comprises an inverted U-shaped member spaced sufficiently to fit over the top of a conventional door.

3. A boot hanger system as defined in claim 2 wherein one of the legs of each said U-shaped member is provided with a centrally located elongated slot near the free end thereof.

4. A boot hanger system as defined in claim 1 wherein each of said first pair of spaced boot supporting members have a centrally located aperture near the top thereof and a centrally located slot near the bottom thereof; said boot supporting members having a flat front and rear face whereby said members will lie flush against a supporting surface and upon insertion of fasteners through said said apertures said members will become securely attached to said flat supporting surface.

5. A boot hanger system as defined in claim 3 wherein said first offset tier boot supporting means comprises a pair of straps with each strap having a closed loop at each end with one loop fed through said elongated slot and the other loop receiving a reverse C-shaped hook having an open free end for engagement with the pull tab of a western style boot.

6. A boot hanger system as defined in claim 4 wherein said first offset tier boot supporting means comprises a pair of straps with each strap having a closed loop at each end with one loop fed through said centrally located slot and the other loop receiving a reverse C-shaped hook; said reverse C-shaped hook having an upper free end including a recess therein for engagement with one of said straps and a lower free end for engagement with the pull tab of a western style boot.

7. A boot hanger system as defined in claim 5 wherein said pair of straps are of different length thereby providing a staggered arrangement to the boots hanging thereon.

8. A boot hanging system as defined in claim 6 wherein said pair of straps are of different lengths thereby providing a staggered arrangement to the boots hanging thereon.

9. A boot hanger system as defined in claim 7 wherein said subsequent offset tier boot supporting means comprises a second pair of straps with closed loops at each end and hooks engaged with said loops whereby the upper hook is attached to said lower loop of said first tier boot supporting means and another pair of boots is attached to the lower hook of said second pair of straps.

10. A boot hanger system as defined in claim 8 wherein said subsequent tier boot supporting means comprises a second pair of straps with closed loops at each end and hooks engaged with said loops whereby the upper hook is attached to said lower loop of said first tier boot supporting means and another pair of boots is attached to the lower hook of said second pair of straps.

11. A boot hanger system as defined in claim 9 wherein said second pair of straps are of equal length.

12. A boot hanger system as defined in claim 10 wherein said second pair of straps are of equal length.

* * * * *